US008379927B2

(12) United States Patent
Taylor

(10) Patent No.: US 8,379,927 B2
(45) Date of Patent: Feb. 19, 2013

(54) RAILCAR UNLOADING SYSTEM

(75) Inventor: Doug F Taylor, Albany, OR (US)

(73) Assignee: Concept Systems Inc., Albany, OR (US)

( * ) Notice: Subject to any disclaimer, the term of this patent is extended or adjusted under 35 U.S.C. 154(b) by 516 days.

(21) Appl. No.: 12/753,675

(22) Filed: Apr. 2, 2010

(65) Prior Publication Data

US 2010/0251924 A1 Oct. 7, 2010

Related U.S. Application Data

(60) Provisional application No. 61/166,075, filed on Apr. 2, 2009.

(51) Int. Cl.
*G06K 9/00* (2006.01)
*B61D 7/30* (2006.01)

(52) U.S. Cl. ..... 382/104; 105/286

(58) Field of Classification Search ..... None
See application file for complete search history.

(56) References Cited

U.S. PATENT DOCUMENTS

| | | | | |
|---|---|---|---|---|
| 3,965,760 | A | 6/1976 | Etheredge, Jr. | |
| 4,522,545 | A | 6/1985 | Peckham | |
| 4,629,386 | A | 12/1986 | Tullos | |
| 7,063,022 | B1 * | 6/2006 | Marchiori et al. | 105/241.2 |
| 7,178,465 | B1 * | 2/2007 | Marchiori et al. | 105/241.2 |

FOREIGN PATENT DOCUMENTS

| | | |
|---|---|---|
| JP | 2008-296914 | 12/2008 |
| WO | WO 2010/115144 | 10/2010 |

OTHER PUBLICATIONS

Gonzates, K., "Non-contact interrogation of railroad axles using laser-based ultrasonic inspection", Rail Conference, 2005. Proceedings of the 2005 ASME/IEEE Joint, Date available: Mar. 16-18, 2005, pp. 145-150.*

* cited by examiner

*Primary Examiner* — Bhavesh Mehta
*Assistant Examiner* — Tahmina Ansari
(74) *Attorney, Agent, or Firm* — Faegre Baker Daniels LLP

(57) ABSTRACT

A system for unloading a railcar includes an imaging system for generating a model of features of the railcar as the railcar enters an unloading station, and an actuation device in communication with the imaging system for identifying a capstan using model information and engaging the capstans to cause the discharge of material from the railcar.

39 Claims, 8 Drawing Sheets t = 100 ms t = 50 ms t = 0 ms

RAILCAR UNLOADING SYSTEM

RELATED APPLICATIONS

The present application claims priority to U.S. Provisional Application Ser. No. 61/166,075, entitled "RAILCAR UNLOADING SYSTEM," filed Apr. 2, 2009, the entire disclosure of which is expressly incorporated herein by reference.

FIELD OF THE INVENTION

The present disclosure generally relates to systems for unloading railcars and more particularly to systems for automatically locating and operating bottom discharge gate assemblies disposed on hopper-style railcars for discharging the contents of the railcar.

BACKGROUND

Trains are used to transport a variety of different types of cargo, including granular or particulate bulk material such as feed, grain, soda ash, and sugar to name a few. Such bulk material is typically carried in hopper-style railcars which include at least one hopper discharge gate assembly. Hopper discharge gate assemblies are generally attached to the bottom of the railcar and include straight sidewalls and sloping end walls that together define a rectangular outlet opening. The gate assembly (or simply "gate") is operable to controllably discharge the bulk material contained in the railcar. More specifically, the gate may be moved laterally between an open position and a closed position by the operation of a rack and pinion drive mechanism powered by an actuation shaft.

The actuation shaft normally includes one or more pinion gears supported by the frame of the gate. Rotation of the shaft about its axis causes lateral movement of the rack coupled to the gate door, thereby opening or closing the gate. The actuation shaft extends laterally outwardly beyond the gate and includes a handle or capstan at one or both ends. The capstans may include any of a plurality of different drive surfaces such as a drive recess or a drive periphery. The drive surface is engaged by a gate opener configured to rotate the actuation shaft and operate the gate.

As is known to those familiar with the industry, it is highly desirable to unload the contents of railcars as quickly (and safely) as possible. In a conventional unloading operation, a railcar is directed through (or parked in) an unloading station. As the railcar moves through the station, a power gate opener, such as a pneumatic gate opener, is moved along with the railcar on a parallel track. The power gate opener is aligned manually with the capstan of the gate, and actuated to rotate the actuation shaft. The bulk material then falls through the gate under the force of gravity and/or is vibrated using a vibrating device to assist the flow of the material through the gate. The falling material lands on a conveyor situated under the railcar and is transported to a storage or shipping location. After the material has been removed from the railcar, the gate opener is again used to close the gate by rotating the actuation shaft in a reverse direction. This process is repeated for the other gates on the railcar and for other cars moving through the unloading station.

Even in unloading stations where the railcars are stationary during unloading, the alignment of the gate opener with the capstan is a difficult task. Moreover, because of the heavy equipment involved, the risk of injury is very high. These concerns are increased when railcars are moved through the unloading station during the unloading process.

SUMMARY

The present disclosure provides a system for unloading a railcar having a door that is movable between a closed position and an opened position wherein material in the railcar is discharged through a discharge opening, the door being movable by an actuation shaft having a capstan with an engagement surface. In one embodiment, the system includes an imaging system including a first camera and a first laser. The first camera obtains first images of portions of the railcar and the first laser scans portions of the railcar to obtain a first plurality of distance measurements. The imaging system is configured to (a) identify the engagement surface of the capstan by comparing the first plurality of distance measurements to known features of the capstan, (b) perform an image analysis of a plurality of the first images generated at predetermined intervals as the railcar moves past the imaging system to determine motion parameters of the railcar, the image analysis including an absolute value difference calculation between adjacent first images, and (c) generate a model of the railcar using the motion parameters to determine the position of the capstan relative to the railcar when the capstan was identified. The system further comprises an actuation device including a frame mounted for movement along a rail, a power gate opener movably mounted to the frame and having a drive surface for engaging the capstan engagement surface, a second camera obtaining second images of portions of the railcar and a second laser scanning portions of the railcar to obtain a second plurality of distance measurements, and a computing device. The computing device is configured to (a) receive information from the model and use the information to initiate movement along the rail toward the capstan, (b) perform the image analysis with of a plurality of the second images generated at second predetermined intervals to track movement of the actuation device relative to the railcar, (c) identify the engagement surface of the capstan by comparing the second plurality of distance measurements to known features of the capstan, (d) control movement of the drive surface of the power gate opener into engagement with the capstan engagement surface as the actuation device moves along the rail, and (e) control movement of the drive surface to move the capstan, thereby moving the door to the opened position to discharge material through the discharge opening of the gate assembly.

The present disclosure further provides a method for unloading a railcar having a rotatable capstan for opening a discharge opening to discharge material from the railcar. The method includes the steps of generating a three-dimensional model of the railcar as the railcar moves to an unloading position using a first camera and a first laser, locating the capstan using the three-dimensional model, controlling movement of an actuation device toward the capstan using a second camera and a second laser mounted to the actuation device, and rotating the capstan using the actuation device to open the discharge opening.

BRIEF DESCRIPTION OF THE DRAWINGS

The above-mentioned aspects of the present teachings and the manner of obtaining them will become more apparent and the teachings will be better understood by reference to the following description of the embodiments taken in conjunction with the accompanying drawings, wherein.

Corresponding reference characters indicate corresponding parts throughout the several views.

DETAILED DESCRIPTION

The embodiments of the present teachings described below are not intended to be exhaustive or to limit the teachings to the precise forms disclosed in the following detailed description. Rather, the embodiments are chosen and described so that others skilled in the art may appreciate and understand the principles and practices of the present teachings.

Figure 1:
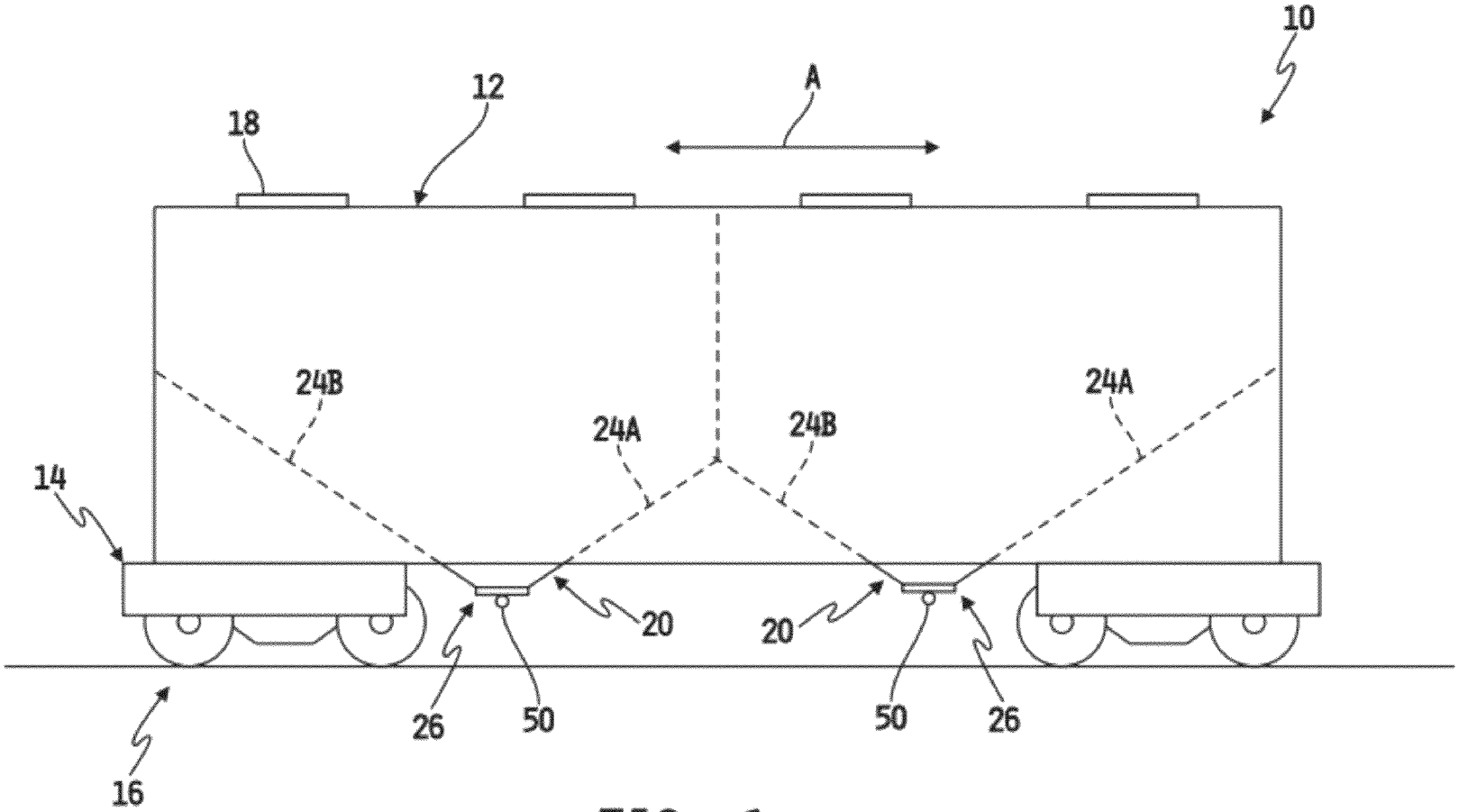
FIG. 1 is a side elevation view of a railcar.

Exemplary embodiments of unloading systems will now be described with reference to the figures. FIG. 1 depicts a typical railcar of the class having a hopper-type body. Railcar 10 includes a multi-walled enclosure 12 mounted to a frame 14, which is supported for movement on pairs of wheeled trucks 16. Railcar 10 further includes top loading hatches 18 for loading of hopper containers 20 defined within enclosure 12. Each hopper container 20 is defined by interior walls 24. The forward interior wall 24A and the rearward interior wall 24B of each hopper container 20 converge toward one another with distance toward the bottom of railcar 10, thereby directing bulk material carried by the hopper container 20 toward a lower opening of the container at which a gate assembly 26 is mounted. While two containers 20, and corresponding gate assemblies 26 are shown in the figure, it should be understood that more or fewer than two containers 20 may be included on railcar 10.

Figure 2:
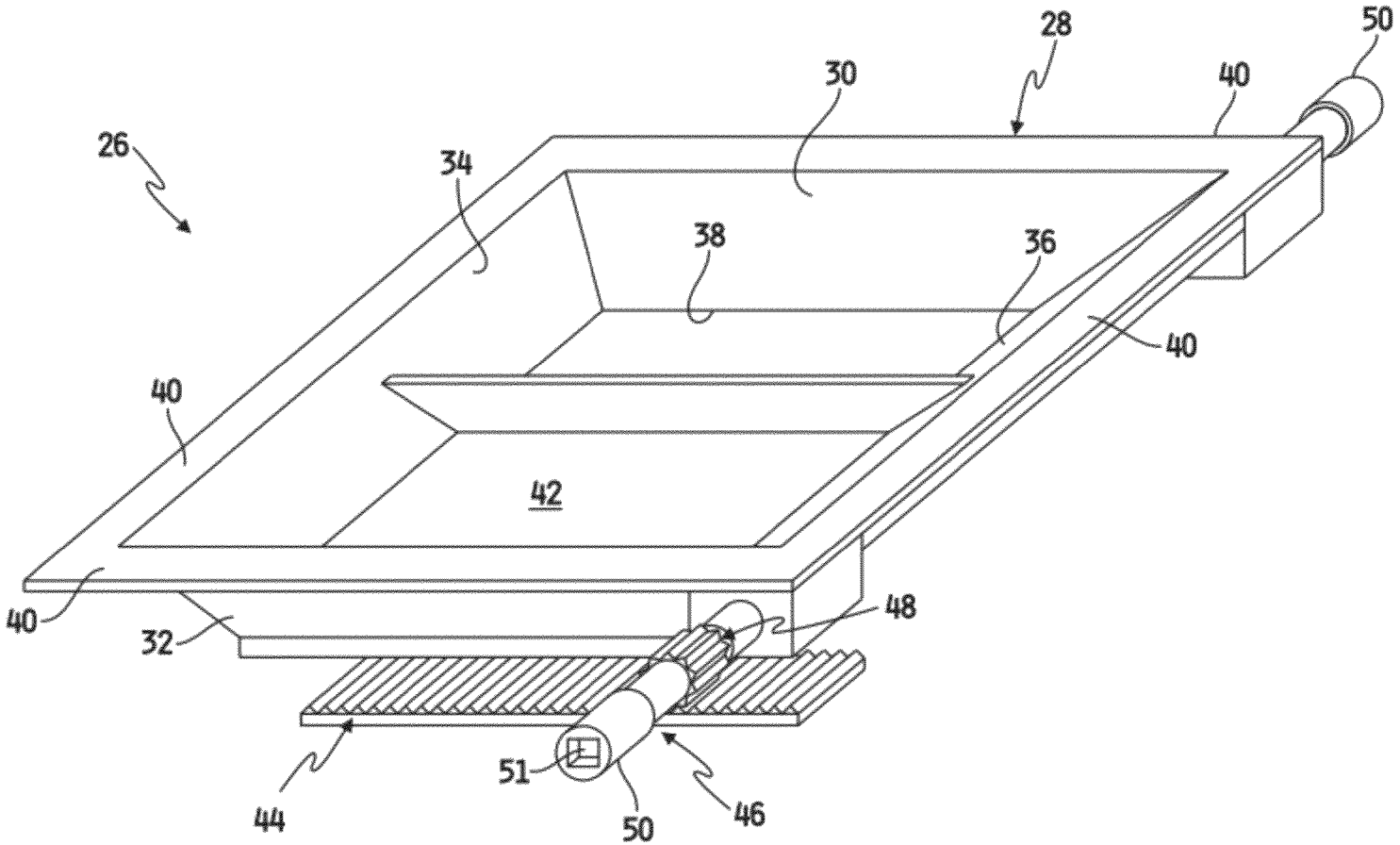
FIG. 2 is a perspective view of a discharge gate.

FIG. 2 depicts a gate assembly 26 configured to control the flow of bulk material through the lower opening of a hopper container 20. Gate assembly 26 includes a frame 28 having generally parallel side walls 30, 32 extending along the travel direction (direction A of FIG. 1) of railcar 10 and opposed, generally parallel end walls 34, 36 extending perpendicular to the travel direction. Walls 30, 32, 34, 36 define a substantially rectangular discharge opening 38. As is depicted in the figure, end walls 34, 36 are angled toward one another in a manner that further promotes the flow of bulk material through discharge opening 38. Mounting flanges 40 are provided along the upper edges of walls 30, 32, 34, 36 to permit mounting of gate assembly 26 to similar mounting flanges (not shown) disposed on the bottom of railcar 10. Gate assembly 26 further includes a door 42 which is coupled to at least one rack 44. At least one actuation shaft 46 is mounted to frame 28. Shaft 46 carries at least one pinion gear 48 which is mounted for mating engagement with rack 44. A capstan 50 is mounted at each end of each shaft 46, includes central drive recess 51, and functions as the handle for rotation of the shaft 46. More specifically, rotation of capstan 50 causes rotation of shaft 46, which in turn (through pinion gear 48) causes linear movement of rack 44 and door 42. Door 42 may be moved in this manner between a closed position wherein the bulk material in hopper container 20 is prevented from leaving the container, and an opened position wherein the bulk material flows through discharge opening 38.

It should be understood that FIG. 2 depicts an example of a typical gate assembly 26. Multiple other configurations exist. For example, some gate assemblies 26 include an actuation shaft 46 that is coupled to door 42 for movement with door 42 when shaft 46 is rotated. In other words, rack 44 is stationary and actuation shaft 46 is moveable with door 42. To permit operation with railcars 10 of all varieties, the actuation device according to the principles of the present disclosure accommodates gate assemblies 26 of this configuration, wherein capstan 50 moves as gate assembly 26 is opened, as is further described below.

Figure 3:
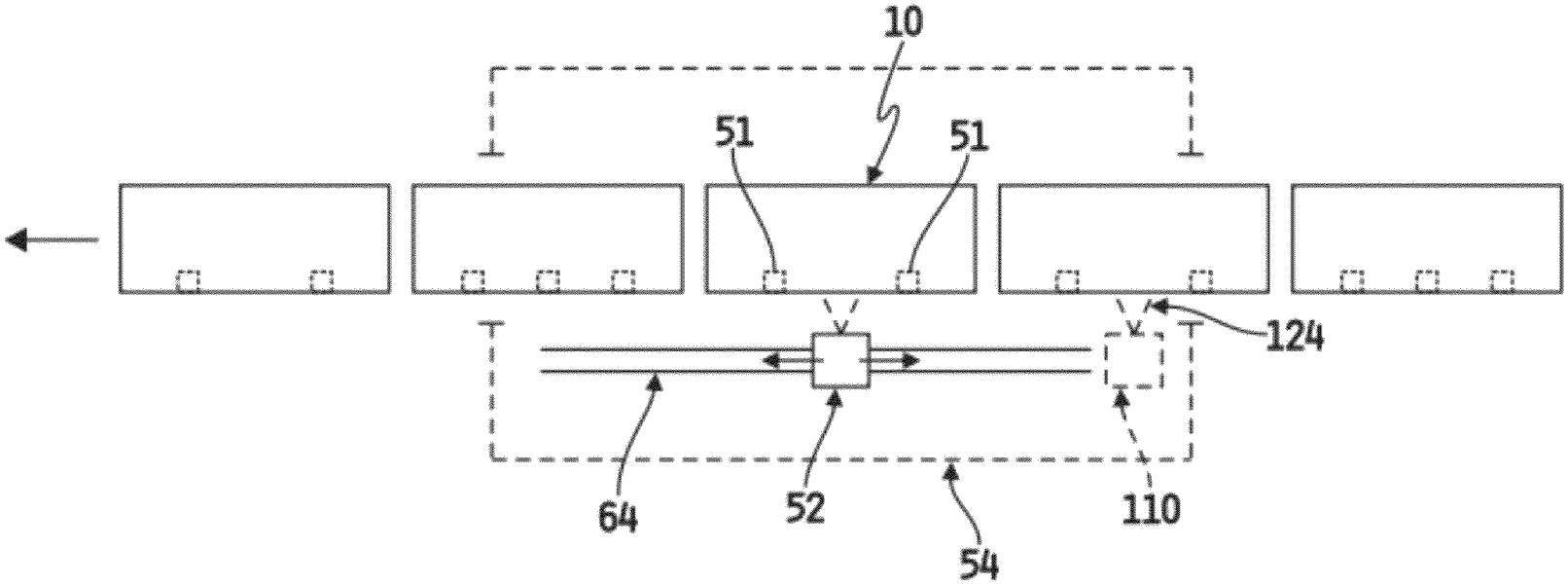
FIG. 3 is a conceptual elevation view of an unloading area showing a plurality of railcars and an exemplary discharging system.

Embodiments of unloading systems will now be described with reference to FIG. 3 and in more detail with reference to FIGS. 4 to 8*e*. In the embodiment of the unloading system shown in FIG. 3, the system includes an actuation device, or car door opener ("CDO") 52, that detects the location and angular orientation of drive recess 51 and automatically engages drive recess 51 to open and close door 42. CDO 52 travels on a rail 64 parallel to railcar 10 and comprises a wheeled base and an engaging surface movable in two or more planes relative to the base. A computing device is operable to translate CDO 52 along rail 64 (A-direction). The engaging surface's position is adjustable up and down (B-direction) and also toward and away the car (C-direction). The engaging surface may be part of a robotic arm mounted on the wheeled base. Alternatively, motors may actuate gear trains supporting a platform which supports the engaging surface in directions B and C, and perhaps also A. Physical encoders may be linked to the motors to track said movement. Physical encoders can be purchased of various accuracies which may be better than 1/100 inch. Encoders such as quadrature pulse counters may be accurate to 1/1000 inch.

CDO 52 comprises a laser scanner operable to locate the position and orientation of drive recess 51 while railcar 10 is parked in an unloading area 54. The laser scanner obtains vertical maps of portions of railcar 10 within its range as CDO 52 moves on rail 64, and the computing device identifies the location and orientation of drive recess 51 in the vertical maps. The operation of the laser scanner is described in detail with reference to FIG. 7. The computing device then causes CDO 52 to stop and causes the engaging surface to align with drive recess 51 (with respect to both location and orientation). The computing device may accurately determine the position of the engaging surface with the physical encoders and the laser scanner's information. Then, CDO 52 moves the engaging surface until it engages drive recess 51. Advantageously, such engagement is performed accurately which substantially reduces the wear and damage to the engaging surface and drive recess 51 which is typical of conventional systems that rely on trial and error making repeated contacts between the engaging surface and drive recess 51 to align them. In the present embodiment, the orientation of drive recess 51 is obtained within at most 15 degrees of the actual capstan orientation. In more preferred embodiments, the orientation is obtainable within 5 degrees, and even more preferably within 1 degree, of the actual capstan orientation. After engagement, CDO 52 opens the door by rotating the capstan. CDO 52 moves in succession from one capstan to the next within unloading area 54 to open gates as desired. Then, CDO 52 repeats the process of finding (acquiring) and engaging capstans, although not necessarily in the same order, to close the gates when all desired materials have been discharged. Only then can railcar 10 move out of unloading area 54 to make room for another railcar 10. Since the number of railcars 10 in a train can exceed 100, a train may have to start and stop dozens of times, depending on the size of unloading area 54, to unload all railcars 10.

CDO 52 may include a material discharge sensor that detects discharged material. CDO 52 may communicate electronically with a supervisory system to receive information concerning the amount of material to discharge and to provide information obtained from the material discharge sensor. CDO 52 may also calculate the time required to discharge the desired amount of material and close the gate at the appropriate time. The material discharge sensor may be a laser scanner, capacitive sensor, optical beam detector and the like.

Advantageously, a video camera (referred to as a "camera"), may be added to the system described above which enables the system to unload railcars while the train is in motion. The camera acquires information useful to track the motion of the train and the relative motion of the train and the CDO. The camera may be provided on CDO 52 or mounted in a stationary position. FIG. 3 illustrates a camera field of view emanating from CDO 52 and another, denoted by numeral 124, emanating from an optional stationary camera in a system 110 which is described in detail with reference to FIG. 6. A computing device, which may be the computing device controlling the CDO or a different one, analyzes a stream of camera images from the camera and determines the motion of the train. Then, the computing device obtains the motion of the CDO and compares the two motions to calculate, and then control, the movement, e.g. velocity, direction and acceleration, of the CDO. If the camera is mounted on the CDO, then the images capture features of railcar 10 which inherently contain information about the relative movement of railcar 10 and the CDO. If the camera is stationary, physical encoders in the CDO provide the CDO motion information, and the computing device then compares the CDO motion information to the train motion information to obtain the relative motion data. Operation of a camera to obtain train motion information is described in detail with reference to FIGS. 8*a* to 8*e*.

Relative motion information enables the CDO to move back and forth along rail 64 opening and closing gates while the train moves through unloading area 54. After the CDO acquires a capstan, the computing device calculates the position of the capstan relative to the moving train based on the relative motion information. Because the computing device tracks the motion of the train, it can also track the position of the acquired capstan relative to unloading area 54 and the CDO. After opening the gate, the CDO moves to acquire the next capstan. After opening the second gate, the CDO can go back to the first gate, guided by the computing device which provides direction and acceleration information, reacquire the first capstan with the laser scanner and close the first gate. The CDO can then move to close the second gate or acquire another capstan. In this manner the CDO acquires capstans one at the time in any desired position and minimizes the amount of time railcar 10 must remain within unlading area 54.

In an alternative moving railcar unloading system, a second camera is provided. One camera is stationary (e.g. a camera in system 110) and tracks the motion of the train, and the other is mounted on CDO 52 and operates as a camera encoder (in lieu or in addition to physical encoders) to track the motion of CDO 52 relative to the train. Advantageously, the CDO camera compensates for motion variation between the actual motion of a particular railcar and the motion of that railcar calculated on the assumption that the motion of the train is consistent. The assumption fails when the train slows down in which case the railcars separate, and when the train speeds-up in which case the railcars come closer together. Size differences between acquired railcar features in successive images can be analyzed to determine the C-direction motion of the CDO which should be minimal unless the camera is itself mounted on a moving platform. Position differences between acquired railcar features in successive images can be analyzed to determine motion in the A and B-directions.

Railcars include gate identification features such as RFID passive transmitters from which the unloading system determines unloading information, e.g. material type and amount of material to discharge. In another embodiment of an unloading system with a camera, the computing system calculates from the unloading identification the amount of time gates must be open, and the maximum speed at which the train can move, to permit unloading the desired amount of material as the train moves through unloading area 54. In other words, the transit time through unloading area 54 must be sufficiently long to enable full discharge (of the desired amount) of every hopper compartment.

Figure 6:
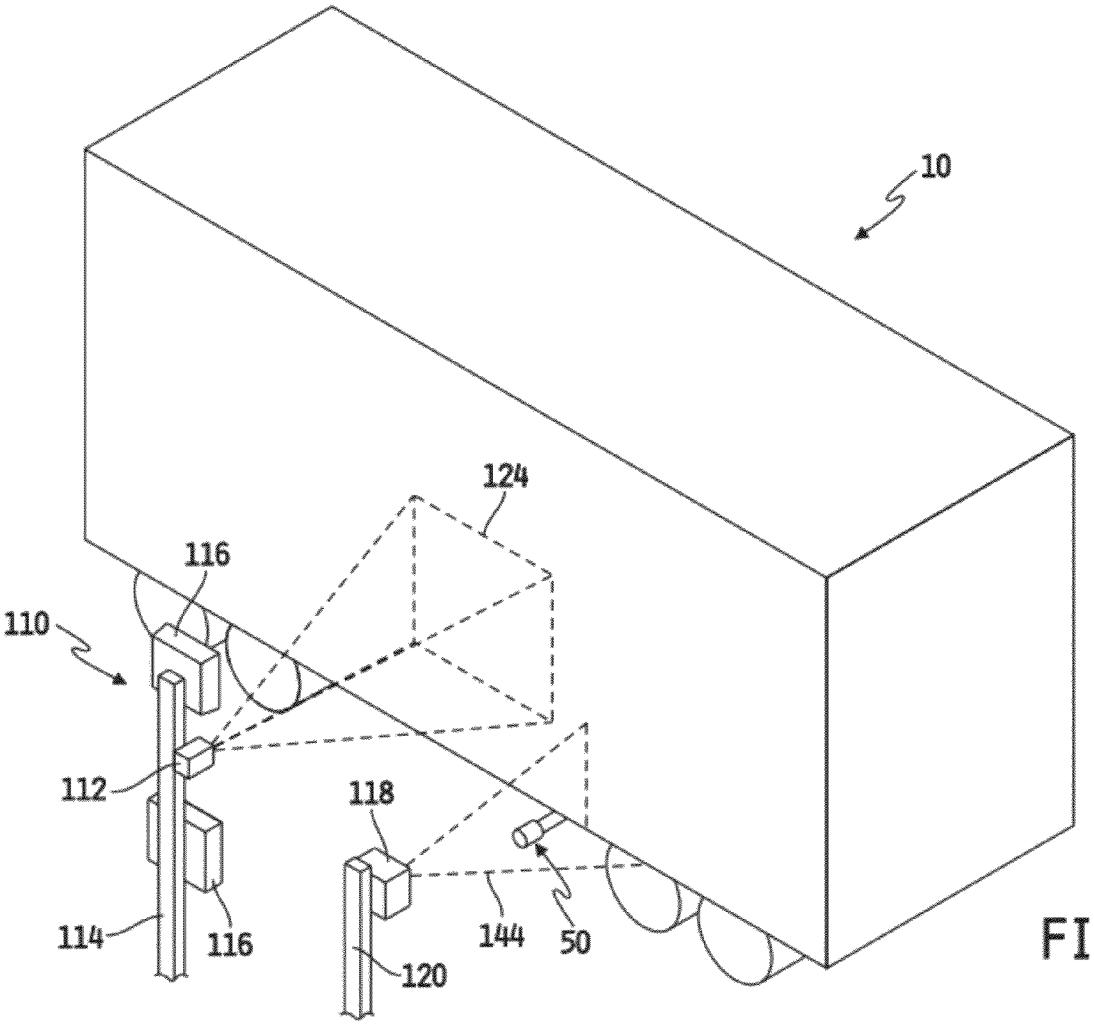
FIG. 6 is a perspective view of a fixed imaging system according to the present disclosure.

In a further embodiment of a moving railcar unloading system, a stationary system is provided that includes a camera and a laser scanner. The stationary system is operable as a supervisory or quality control system to ensure that all the train hoppers are properly emptied. One or more lights are provided to assist in the video acquisition process. Components of such a system are illustrated in FIG. 6. The stationary camera and the computing device perform the train motion analysis in the manner previously described. the stationary laser scanner acquires drive recesses 51 entering unloading area 54. The system also obtains unloading information, e.g. reads RFID tags. The system models the train based on the number of drive recesses 51 and calculated distances between (based on motion information). The CDO receives information from the supervisory system, reacquires the drive recesses 51 as described previously to open and close gate assemblies 26, and communicates to the supervisory system when the gates are opened and closed. The supervisory system then compares the model to the gate opened/closed information to ensure every hopper has been emptied that should have been emptied.

Figure 4:
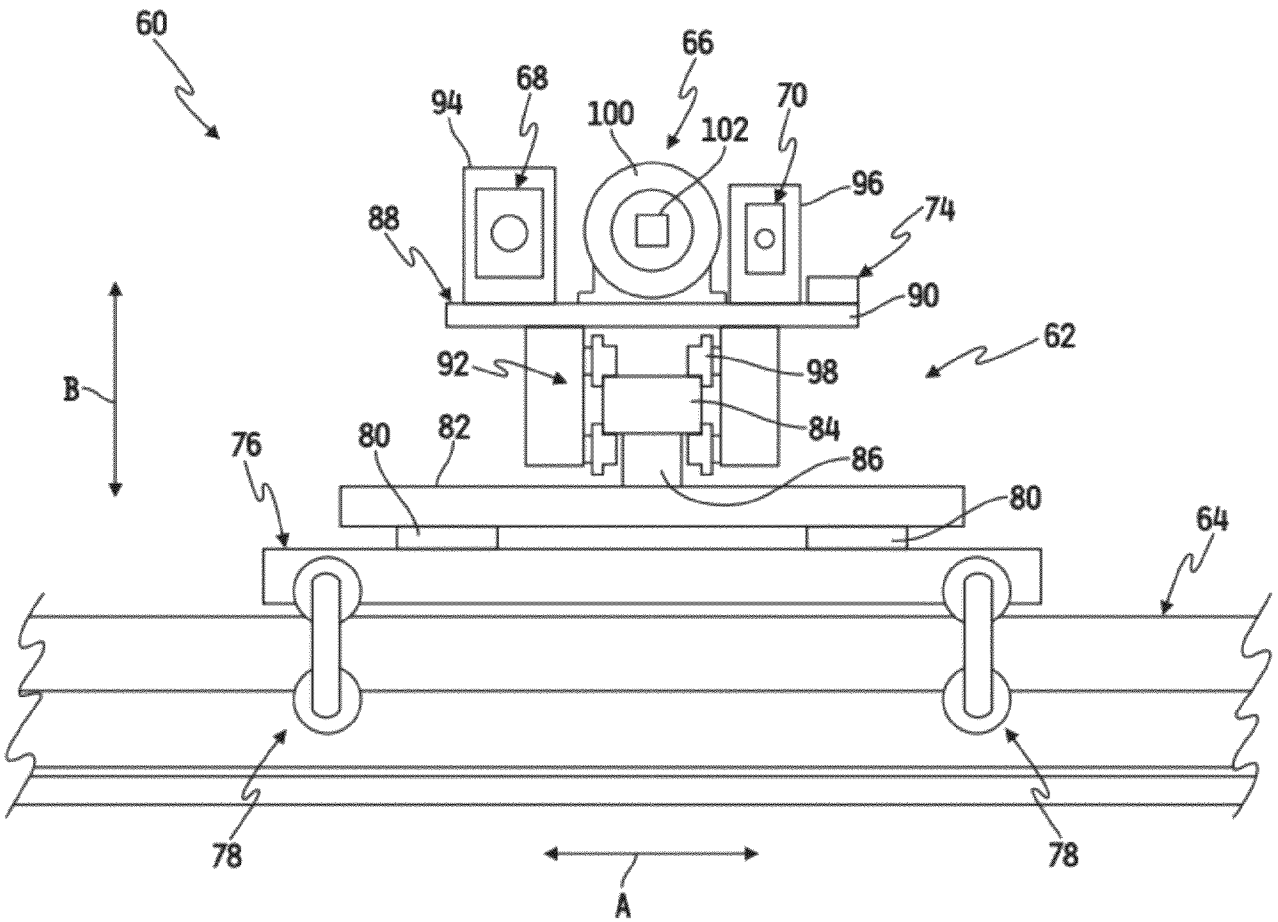
FIG. 4 is a front elevation view of an actuation device according to the present disclosure.
Figure 5:
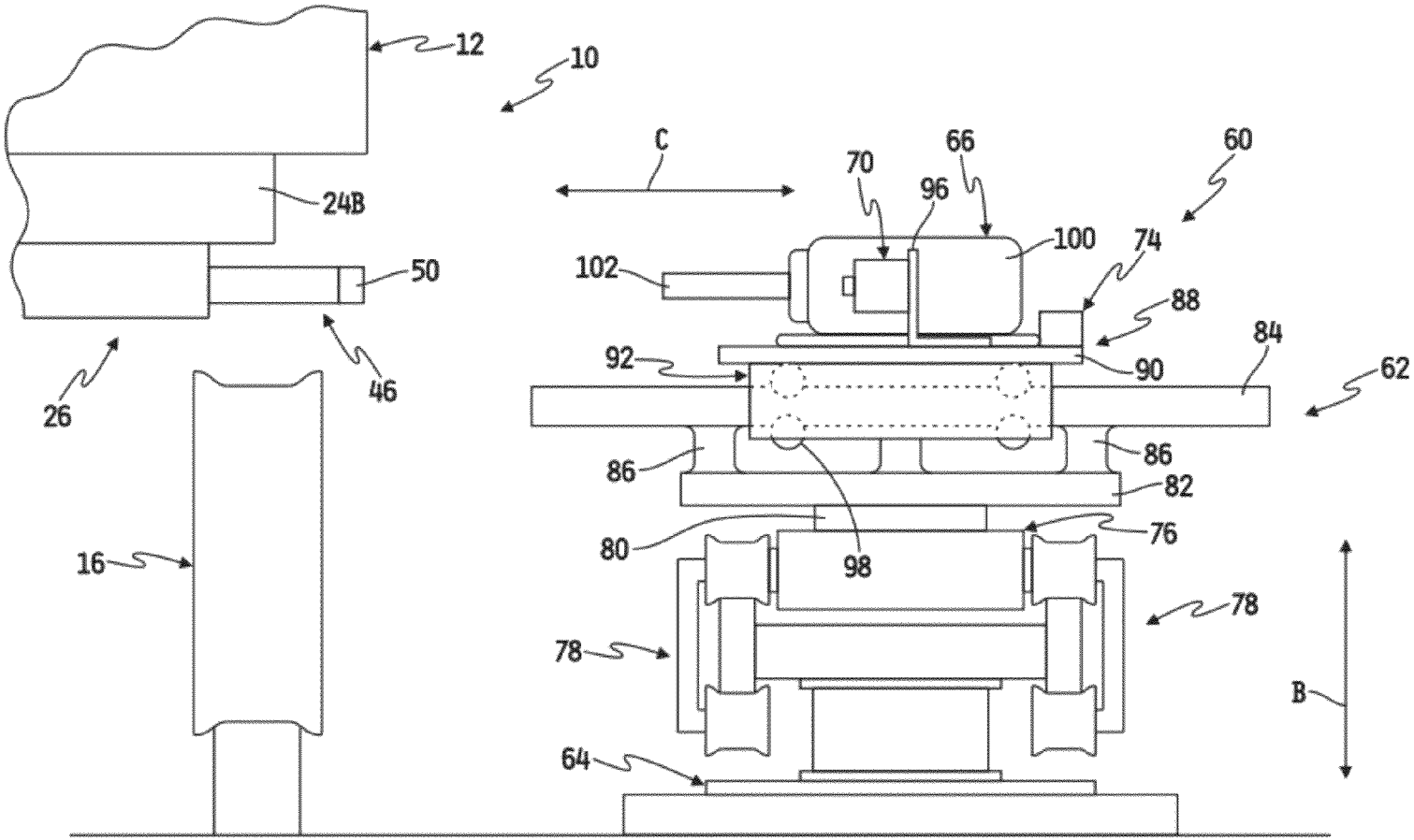
FIG. 5 is a side elevation view of the actuation device of FIG. 4.

FIGS. 4 and 5 depict an actuation device according to the principles of the present disclosure. Actuation device 60 includes a frame 62 that is mounted on a rail 64, a power gate opener 66, a camera 68, a laser assembly 70, and a computing device 74. Rail 64 is positioned in the unloading area to run in direction A, parallel to the railroad tracks carrying railcar 10.

Frame 62 includes a base 76 coupled to a plurality of roller carriages 78 configured to engage rail 64. A motor (not shown) is also mounted to base 76 and configured to cause controlled motion of actuation device 60 in direction A along rail 64 on carriages 78. As is further described herein, this controlled motion parallel to railcar 10 permits alignment of gate opener 66 with capstan 50. One or more lifts 80 are also mounted to base 76. Lifts 80 provide vertical adjustment in direction B of the position of gate opener 66 to align gate opener 66 with capstan 50. Lifts 80 may be powered by any suitable actuator (not shown) using pneumatic, electrical, or mechanical power.

Frame 62 further includes a mount 82 supported by lifts 80, and a guide rail 84 supported on mount 82 by at least one brace 86. As is further described below, guide rail 84 is positioned perpendicular to rail 64 to permit movement of gate opener 66 in direction C toward and away from capstan 50.

Gate opener 66 is mounted to a movable carriage 88 including a horizontal platform 90 and a pair of support members 92. Camera 68 is mounted to platform 90 by a bracket 94. Similarly, laser assembly 70 is mounted to platform 90 by a bracket 96. Each support member 92 includes a plurality of rollers 98 mounted to engage guide rail 84. Movable carriage 88 further includes a motor (not shown) that facilitates controlled movement of movable carriage 88 along guide rail 84 on rollers 98.

Computing device 74 is also shown mounted to platform 90. It should be understood, however, that computing device 74 may be mounted in any of a plurality of different locations, either on or off of actuation device 60. Computing device 74 may consist of a commercially available personal computer coupled to I/O hardware for communicating with the various motors of actuation device 60, camera 68, and laser assembly 70, as well as other possible equipment within the unloading station such as audio and visual warning indicators, safety gates, etc. Alternatively, computing device 74 may consist of dedicated hardware configured for the sole purpose of operating actuation device 60.

It should be understood that the rollers of roller carriages 78 may be driven to cause movement of base 76, or an engagement mechanism, such as a rack and pinion assembly, worm gear, etc., may be mounted to base 76 and rail 64 to cause movement of base 76. In such an embodiment, roller carriages 78 simply retain base 76 in alignment with rail 64 and carry the weight of actuation device 60. Similarly, rollers 98 of support members 92 may be driven to cause movement of movable carriage 88 along guide rail 84, or an engagement mechanism, such as a rack and pinion assembly, worm gear, etc., may be mounted to movable carriage 88 and guide rail 84 to cause movement of movable carriage 88. In such an embodiment, rollers 98 simply retain movable carriage 88 in alignment with guide rail 84 and carry the weight of movable carriage 88 and gate opener 66.

It should be further understood that gate opener 66 may be any of a variety of different, commercially available gate opening devices, all of which generally include a motor 100, such as a high-torque, low-speed motor, configured to rotate a drive shaft 102. For example, gate opener may be a 5 or 6-axis articulated robot arm with a sufficiently large payload capacity to produce the torque required to open and close gate assemblies 26 using capstans 50. Of course, in embodiments utilizing an articulated robot arm, many of the above-described structure for facilitating adjustment of gate opener 66, particular in directions B and C, may be omitted. Depending upon the gate opening device selected, drive shaft 102 may include a recess for engaging a drive periphery on capstan 50, an extension for engaging a central drive recess on capstan 50 (such as drive recess 51 of FIG. 2), or one or more gripping devices for engaging capstan 50. As is further described below, forward and reverse rotation of gate opener 66 are controlled by computing device 74.

As is well known in the art, the number, location (in directions B and C) and spacing (in direction A) of actuation shafts 46 (and therefore capstans 50) of railcar 10 can differ from railcar to railcar. Accordingly, it is not feasible to simply locate one capstan 50 as railcar 10 enters the unloading station and deduce the number and positions of other capstans 50. As such, conventional unloading systems require an operator to manually align a gate opener with each capstan 50 to open and close the corresponding gate assembly 26. Using an unloading system according to the present disclosure, a camera such as camera 68 is used at the entry of the unloading station to count and locate (in directions A and B) capstans 50 associated with an incoming railcar 10.

In one embodiment of the present invention, a fixed imaging system 110 as shown in FIG. 6 is located adjacent the entrance of the unloading station to acquire data to build a model of the undercarriage of railcar 10 as it enters the unloading station in the manner described below. The model permits fixed imaging system 110 to identify capstans 50 as they enter the unloading station, measure the movement of the capstans 50 after they pass fixed imaging system 110 and move to an unloading position, and provide this information to actuation device 60. Actuation device 60 then re-acquires the capstans 50, opens the gate assemblies 26, and closes gate assemblies 26 in the manner described below. The model may be a 3D model.

Fixed imaging system 110 includes a camera 112 (similar to camera 68) mounted to a post 114 along with a plurality of lights 116, and a laser scanner 118 (similar to laser assembly 70) mounted to a post 120. As depicted in FIG. 6, post 120 is located closer to railcar 10 than post 114 to permit the proper scanning of laser 118 to identify structure of the undercarriage of railcar 10 (e.g., capstans 50). Additionally, laser 118 is mounted lower relative to the ground than camera 112. Camera 112 and laser 118 are, however, directed toward railcar 10 in substantially the same plane.

Camera 112 is used to track the position and movement of railcar 10 as it passes through the field of vision of camera 112. Camera 112 essentially performs the same function as a conventional encoder would perform if it were fixed to railcar 10 (i.e., permitting the closed loop determination of the actual position of railcar 10). Laser 118, on the other hand, determines the distance to objects within its scanning window in the manner described below.

Figure 7:
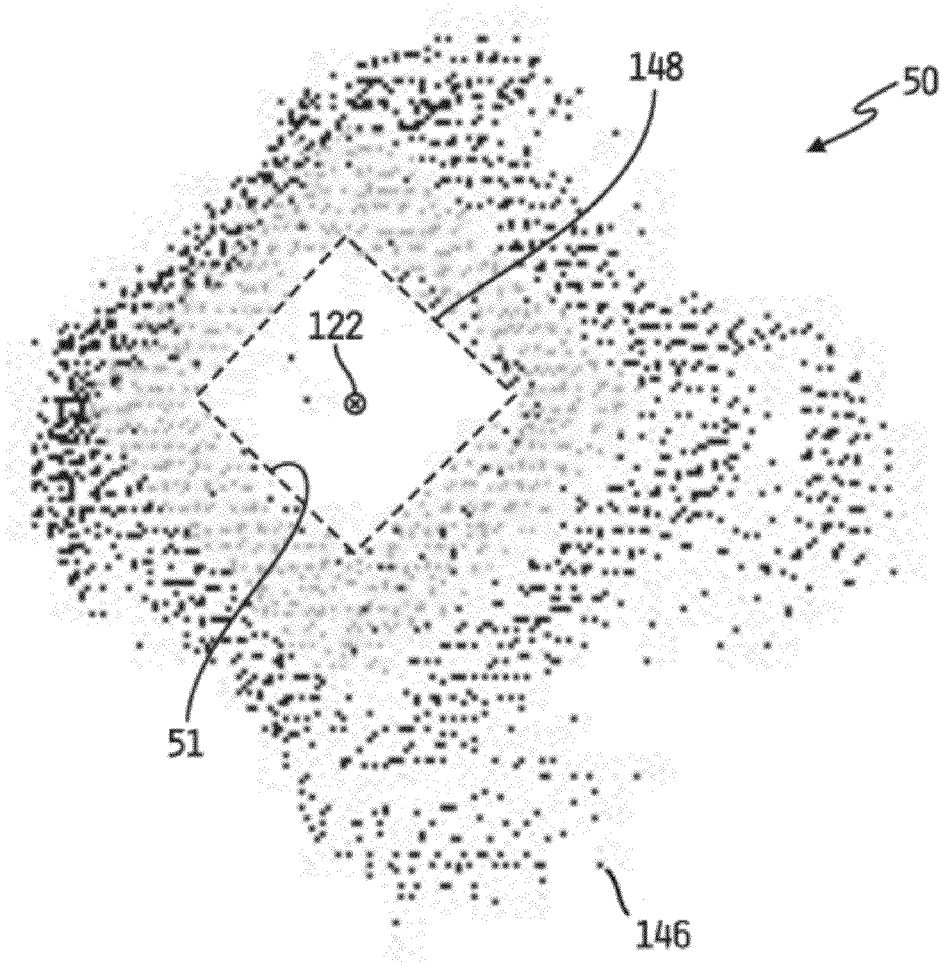
FIG. 7 is a perspective view of a model of a capstan.

The resulting data yields a 3D point cloud model of the undercarriage of railcar 10. By filtering this data in the manner described below, system 110 identifies islands of points which appear unconnected to the surrounding structure. These islands are further analyzed to identify islands with substantially square centers of an appropriate size, thereby indicating a capstan 50. The computing device then superimposes a square pattern on the cloud model representation of capstan 50 and then rotates the square pattern to evaluate the orientation of the capstan. After each gradual rotation, the computing device performs a fit analysis comparing the square pattern to the distance measurements in the cloud model fitting within the square pattern. A good fit exists when the least number of distance measurements appear within the square. When the fit analysis degrades, the square has been rotated too far and the computing device then interpolates the previous two rotations to determine the appropriate orientation of the capstan. The computing device may also average the two rotations instead. FIG. 7 depicts a 3D model of a capstan 50 identified in this manner. When a capstan 50 center point 122 is thus identified, system 110 tracks its movement and location as it enters the unloading station.

Figure 8C:
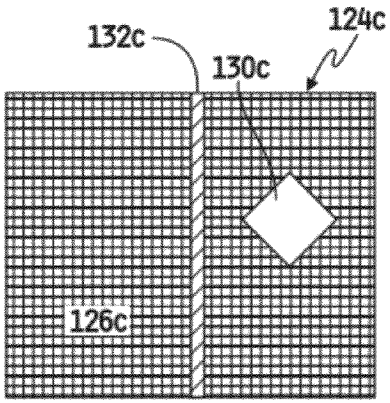
FIGS. 8*a*-8*e* are conceptual views of images obtained and processed using the fixed imaging system of FIG. 7.
Figure 8B:
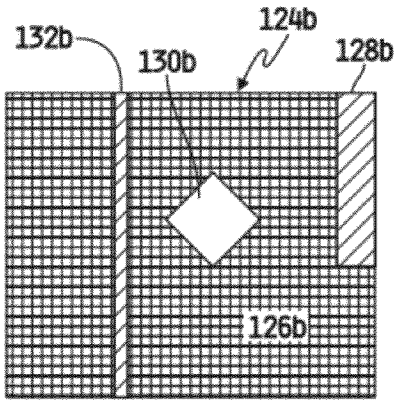
Figure 8A:
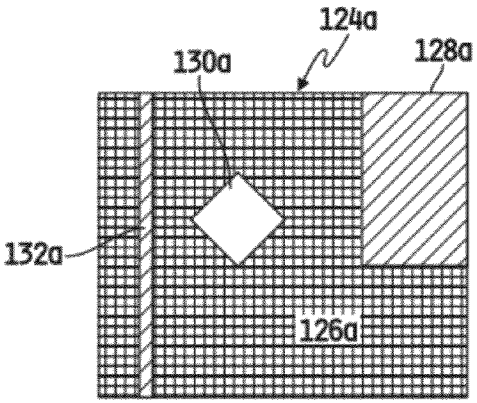

Referring now to FIGS. 8*a-e*, a tracking and motion detection method employed by an embodiment of the present disclosure is depicted. FIGS. 8*a-e* depict the field of view 124 of camera 112, and the objects within that field of view at different points in time as railcar 10 moves past fixed imaging system 110 and into the unloading station. More specifically, FIG. 8*a* shows field of view 124*a*, which includes an area 126*a* of the side wall of railcar 10 at time t=0. Area 126*a* includes a rectangular feature 128*a* (such as a door), a diamond shaped feature 130*a* (such as a sign or decal), and a vertical feature 132*a* (such as a reinforcement rib of the side wall). As shown, area 126*a* is the darkest color. Rectangular feature 128*a* and vertical feature 132*a*, which are both the same color, are the next darkest color. Diamond feature 130*a* is the lightest color. It should be understood that while the figures depict the objects in field of view 124*a* in shades of gray, a true color implementation of the methods described herein may be employed using the same general concepts.

Camera 112 may remain constantly activated during operation of the unloading station or be activated upon entry of railcar 10 using any of a variety of conventional motion detection technologies. Once activated, camera 112 is controlled to obtain images at fixed intervals of time, such as every 50 milliseconds. As indicated above, the image depicted in FIG. 8*a* was taken at time t=0. The image depicted in FIG. 8*b* was taken at time t=50 milliseconds (or whatever suitable interval is chosen). As shown in FIG. 8*b*, field of view 124*b* includes the same objects, but they have shifted position relative to field of view 124*a* as a result of motion of railcar 10 to the right.

Similarly, FIG. 8*c* depicts field of view 124*c* at time t=100 milliseconds. As shown, the rectangular feature has moved entirely out of field of view 124*c* as a result of the further rightward motion of railcar 10.

Figure 8E:
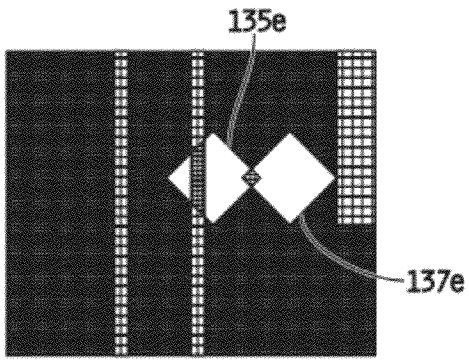
Figure 8D:
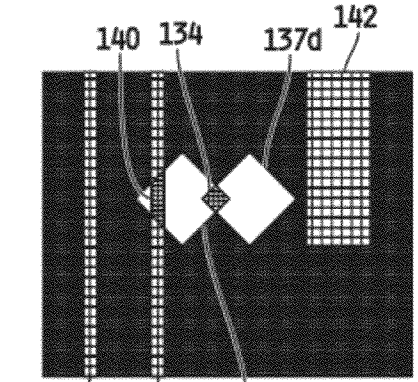

System 110 measures the movement of railcar 10 by processing images such as those depicted in FIGS. 8*a-c*. System 110 includes a memory (not shown) that stores, in one embodiment, three images at a time for processing. Here, the three images are those depicted in FIGS. 8*a-c*. To accurately measure the movement of railcar 10, system 110 first performs an absolute value difference calculation for adjacent images stored in the memory. The result of the absolute value difference calculation for the images of FIGS. 8*a* and 8*b* is shown in FIG. 8*d*. Similarly, the result of the absolute value difference calculation for the images of FIGS. 8*b* and 8*c* is shown in FIG. 8*e*.

Referring now to FIG. 8*d*, one can see that any location within field of view 124*d* that was occupied by area 126*a* of the side wall in FIG. 8*a* at time t=0 and is also occupied by area 126*b* in FIG. 8*b* at time t=50 is entirely black. This is because the difference between those areas is essentially zero (assuming an entirely uniform color for area 126). Likewise, the area occupied by rectangular feature 128*b* in FIG. 8*b* is shown as entirely black in FIG. 8*d* because a portion of rectangular feature 128*a* also occupied that space in FIG. 8*a*. That is, the difference between the color of the area defining rectangular feature 128*b* in field of view 124*b* and that same area in FIG. 8*a* is zero because in both images, the area is occupied by rectangular feature 128.

Similarly, an area 134 of field of view 124*d* corresponding to the intersection between the two positions 135*d*, 137*d* diamond feature 130 shown as entirely black. Again, this is because area 134 was occupied by a portion of diamond features 130*a* and 130*b* in the images of both FIGS. 8*a* and 8*b*. Even though diamond feature 130 is light in color, in the difference image of FIG. 8*d* any overlap is black because the difference in color is zero.

Focusing now on vertical feature 132, it is first shown at location 136 in FIG. 8*d* as dark gray because the difference between the color of vertical feature 132*a* in FIG. 8*a* and the color of area 126*b* in the location formerly occupied by vertical feature 132*a* in FIG. 8*b* is a non-zero quantity. Similarly, vertical feature 132 is also shown at location 138 in FIG. 8*d* as dark gray, except for portion 140 which intersects with diamond feature 135*d*, because the difference between the color of area 126*a* in FIG. 8*a* and the color of vertical feature 132*b* in the location formerly occupied by area 126*a* is a non-zero quantity. The same shade of gray is shown in the area 142 of field of view 124*d* because the difference between the color of rectangular feature 128*a* in FIG. 8*a* and the color of area 126*b* in the location formerly occupied by rectangular feature 128*a* in FIG. 8*b* is, in this example, the same non-zero quantity.

Finally, portion 140 of FIG. 8*d* is shown as a very dark shade of gray. In FIG. 8*a*, portion 140 was occupied by diamond feature 130*a*. In FIG. 8*b*, portion 140 was occupied by vertical feature 132*b*. The shades of gray used for these two features are relatively close. Therefore, portion 140 is depicted as very dark gray as a result of the low difference between the features.

FIG. 8*e* is an absolute value difference image generated from the images of FIGS. 8*b* and 8*c* in the manner described above.

System 110 next further processes the images of FIGS. 8*d* and 8*e* to measure the relative change in position of the "white spaces" (i.e., objects within field of view 124 that moved). System 110 first analyzes the pixels of the image of FIG. 8*d* to identify non-black areas. System 110 then similarly analyzes the pixels of the image of FIG. 8*e* to locate matching non-black areas. For example, diamond feature 135*d* of FIG. 8*d* may be identified as matching (or nearly matching) diamond feature 135*e* of FIG. 8*e*. Using a caliper tool, system 110 then measures the relative change in position of objects from FIG. 8*d* to FIG. 8*e*. The caliper tool uses a vertical and a horizontal search of the images of FIGS. 8*d* and 8*e* to identify these position changes.

It should be understood that although the images of FIGS. 8*d* and 8*e* include a very small number of objects, the actual images of a moving railcar will include many objects, and therefore many "white spaces" that change position. Additionally, the objects in actual images will change position at slightly different rates. Accordingly, system 110 sorts all of the position changes identified in the manner described above from lowest to highest. In one embodiment of the invention, the median position change is then identified as the measured position change of railcar 10 over the sample period. In this example, the median position change indicates the distance railcar 10 traveled over the last 50 milliseconds.

The next distance measurement is taken using the same technique, but the first image (FIG. 8*a*) is discarded and a new image is used. More specifically, after camera 112 takes an image at time t=150 milliseconds, a new absolute value difference image is generated by comparing the image of FIG. 8*c* to the new image taken at time t=150 milliseconds. System 110 then uses the caliper tool to measure changes in relative position of "white spaces" from FIG. 8*e* to the new absolute value difference image in the manner described above. This process continues such that system 110 obtains a distance measurement for every sample period as railcar 10 moves past system 110.

The information from laser 118 is coupled with the distance information obtained using camera 112 to generate the model mentioned above. More specifically, laser 118 emits a beam toward the undercarriage of railcar 10 and detects the time required for the beam to strike objects and reflect back to laser 118 (i.e., conventional radar technology). As the speed of beam is known, the distance from laser 118 to the object can be calculated.

As indicated in FIG. 6, laser 118 is a scanning laser in that it rapidly directs its beam through a vertical path 144. In one embodiment of the disclosure, vertical path 144 is a 60 degree window, and laser 118 obtains a distance measurement at 240 angles within that window (i.e., every one-quarter degree) every five milliseconds. The resulting data essentially provides a vertical map of the surfaces of the objects in front of laser 118 (within the window) every five milliseconds. As the data collection of laser 118 is synchronized with the data collection of camera 112, in such an embodiment, ten vertical "slices" of surface data are taken during each 50 millisecond image processing cycle as described above. As system 110 measures the distance of travel of objects passing system 110 every 50 milliseconds, system 110 can readily produce a 3D model of the passing objects.

As indicated above, by filtering the data comprising the 3D model, system 10 identifies isolated structures, and in particular structures that include a substantially square central feature. This processing of the data is performed at regular intervals. FIG. 7 depicts data included in a 3D model of a capstan 50 identified using this process. As shown, the model of capstan 50 is made up a plurality of measurement points 146 obtained using laser 118. Dotted line 148 of FIG. 7 identifies the substantially square central feature of capstan 50. System 110 measures the square central feature and compares the measurement to known measurements of drive recess 51. When system 110 locates an appropriately sized central feature on an isolated object, system 110 identifies the central feature as a capstan drive recess 51 and determines the center point of drive recess 51. Thereafter, system 110 tracks the movement and location of drive recess 51 in inches from the vertical scanning path 114 of laser 118 as railcar 10 moves farther into the unloading station.

After all capstan drive recesses 51 have been identified, the modeling data is communicated to computing device 74 of actuation device 60 using any of a variety of conventional communication techniques.

Camera 68 of actuation device 60 may be of the same type as camera 112 of fixed imaging system 110. Camera 68 is directed toward railcar 10 (i.e., with a line of sight in direction C) and is used to measure the movement of actuation device 60 along rail 64 relative to railcar 10. Camera 68, in conjunction with computing device 74, performs this function in the same manner as described above with reference to system 110.

Computing device 74 initiates an opening operation for each capstan 50 identified during entry of railcar 10. More specifically, computing device 74 uses the 3D model to determine the offset from the vertical scanning path 144 of laser 118 for each capstan 50 (more specifically, the center point 122 of each capstan drive recess 51) to position gate opener 66. The offsets between camera 68 and the center of drive shaft 102 of gate opener 66 in the A and B directions are fixed, known values based on the mounting locations of camera 68 and gate opener 66. Accordingly, computing device 74 determines the travel distance for actuation device 60 away from laser 118 in the A direction to position drive shaft 102 at the location (in the A direction) of the first capstan 50. Computing device 74 then commands the motor (not shown) that drives base 76 to move actuation device 60 a corresponding distance along rail 64.

As actuation device 60 moves toward the first capstan 50, camera 68 and laser assembly 70 are used in the manner described above with reference to fixed imaging system 110 to reacquire the first capstan 50 and drive recess 51. This reacquisition is necessary because capstan 50 will likely occupy a position relative to rail 64 that differs from the expected position using the 3D model generated by fixed imaging system 110. This change in position is caused by a variety of factors, such as the play in the A direction permitted by the coupling between railcars 10, and movements in the B and C directions resulting from differences in the relative positions of the track carrying railcar 10 and rail 64 carrying actuation device 60, and the vertical movement of railcar 10 as material is unloaded from the railcar.

After drive recess 51 is reacquired, computing device 74 determines the travel distance for mount 82 in the B direction to position drive shaft 102 at the location (in the B direction) of the first capstan 50 by accounting for the offset (in the B direction) between camera 58 and drive shaft 102. Computing device 74 then commands the motor (not shown) that drives lifts 80 to move mount 82 a corresponding distance in direction B. At this point, drive shaft 102 is aligned in the A and B directions with drive recess 51 of capstan 50.

After actuation device 60 is positioned in the A and B directions in the manner described above, computing device 74 commands the motor (not shown) that drives movable carriage 88 to move movable carriage 88 along guide rail 84 a distance corresponding to the distance between the first capstan 50 and the end of drive shaft 102. It should be further understood that as (or before) movable carriage 88 moves toward capstan 50, motor 100 of gate opener 66 may also be actuated by computing device 74 to rotate drive shaft 102 into a position corresponding to the orientation of drive recess 51 of capstan 50. In this manner, drive shaft 102 is aligned with and engages drive recess 51. Computing device 74 then actuates motor 100 to cause rotation of drive shaft 102 (and capstan 50 and actuation shaft 46), thereby opening door 42 of gate assembly 26. The bulk material is then released through gate assembly 26 onto a conveyor (not shown) or other transport or storage device.

Actuation device 60 may be configured according to the principles of the present disclosure to move as drive shaft 102 rotates. As mentioned above, in some types of gate assemblies 26, actuation shaft 46 moves with door 42 instead of the other way around as depicted in FIG. 2. Accordingly, actuation device 60 must move simultaneously with door 42 to carry out the door opening process. Moreover, railcar 10 generally moves slightly in direction A as material falls through opening 38 of gate assembly 26, thereby reducing the weight of railcar 10. Actuation device 60 monitors the position of capstan 50 as drive shaft 102 opens gate assembly 26 and causes the motors to adjust the position of drive shaft 102 in the manner described herein.

As should be apparent from the foregoing, gate opener 66 is retracted from drive recess 51 of first capstan 50 after gate assembly 26 is opened and moved into engagement with another capstan 50 using the principles described above. Computing device 74 may be programmed to wait a predetermined period of time after opening a gate assembly 26 before causing actuation device 66 to close gate assembly 26. This time period may be selected to permit a discharge of a desired quantity of bulk material, or to permit the discharge of the entire contents of hopper container 20 associated with capstan 50. During the waiting period, computing device 74 may control the operation of actuation device 60 to position drive shaft 102 into engagement with another capstan 50 to open another corresponding discharge gate 26. In one embodiment of the present disclosure, actuation device 60 is equipped with a horizontal laser (not shown) positioned to detect material falling from discharge gates 26. Actuation device 60 may be positioned at an opened gate 26 and the horizontal laser may provide a signal to computing device 74 when it no longer senses material falling though the gate. Thereafter, drive shaft 102 is again positioned into engagement with drive recess 51 and rotated to close gate assembly 26 and proceed to the next opened gate. After all of gate assemblies 26 are opened and closed in the manner described above, computing device 74 may return actuation device 60 to its default position in the unloading station. The default position defines a known location of drive shaft 102 in the A direction along rail 64, in the B direction above rail 64, and in the C direction along guide rail 84. System 110 may then communicate with the indexing system of the unloading station to request that more railcars 10 be moved into the unloading station. This process continues until all railcars 10 are unloaded.

In another example of the operation of actuation device 60, railcar 10 remains continuously in motion through the unloading station. The movement of railcar 10 is periodically determined in the manner described above with reference to camera 112 of fixed imaging system 110. After a first drive recess 51 is located, system 110 may, using the 3D model as described above, cause actuation device 60 to move along rail 64 at a speed sufficient to catch up to the driver recess 51. Computing device 74 may control the operation of actuation device 60 in the manner described above, while also accounting for the motion of railcar 10 using real time movement measurements of railcar 10 received from system 110. As such, drive shaft 102 may be aligned with and engage capstan recesses 51 as railcar 10 moves through the unloading station.

In a variation of one of the embodiments of the present disclosure, laser assembly 70 is mounted at an angle other than 90 degrees relative to direction A. In this manner, actuation device 60 may track movement of actuation shaft 46 using laser assembly 70 of capstan 50 in direction C (i.e., toward and away from actuation device 60).

While an exemplary embodiment incorporating the principles of the present teachings has been disclosed hereinabove, the present teachings are not limited to the disclosed embodiments. Instead, this application is intended to cover any variations, uses, or adaptations of the disclosed general principles. Further, this application is intended to cover such departures from the present disclosure as come within known or customary practice in the art to which this application pertains and which fall within the limits of the appended claims.

What is claimed is:

1. A system for unloading a railcar having a door that is movable between a closed position and an opened position wherein material in the railcar is discharged through a discharge opening, the door being movable by an actuation shaft having a capstan with an engagement surface, the system including:

an imaging system including a first camera and a first laser, the first camera obtaining first images of portions of the railcar and the first laser scanning portions of the railcar to obtain a first plurality of distance measurements, the imaging system being configured to identify the engagement surface of the capstan by comparing the first plurality of distance measurements to known features of the capstan, perform an image analysis of a plurality of the first images generated at predetermined intervals as the railcar moves past the imaging system to determine motion parameters of the railcar, the image analysis including an absolute value difference calculation between adjacent first images, and generate a model of the railcar using the motion parameters to determine the position of the capstan relative to the railcar when the capstan was identified, an actuation device including a frame mounted for movement along a rail, a power gate opener movably mounted to the frame and having a drive surface for engaging the capstan engagement surface, a second camera obtaining second images of portions of the railcar and a second laser scanning portions of the railcar to obtain a second plurality of distance measurements, and a computing device configured to receive information from the model and use the information to initiate movement along the rail toward the capstan, perform the image analysis with of a plurality of the second images generated at second predetermined intervals to track movement of the actuation device relative to the railcar, identify the engagement surface of the capstan by comparing the second plurality of distance measurements to known features of the capstan, control movement of the drive surface of the power gate opener into engagement with the capstan engagement surface as the actuation device moves along the rail, and control movement of the drive surface to move the capstan, thereby moving the door to the opened position to discharge material through the discharge opening of the gate assembly.

2. The system of claim 1, wherein the first camera and the first laser are mounted in substantially the same plane.

3. The system of claim 1, wherein the first laser is a scanning laser configured to obtain the first plurality of distance measurements along a vertical path at fixed intervals of time.

4. The system of claim 1, wherein the actuation device further includes an articulated robot arm.

5. The system of claim 1, wherein the railcar includes a plurality of doors and a corresponding plurality of capstans and the computing device is configured to control movement of the power gate opener to move each of the plurality of capstans to open each of the plurality of doors.

6. The system of claim 5, wherein the computing device is configured to cause closing of the door by controlling rotation of the drive surface to move the capstan in an opposite direction after a portion of the material is discharged.

7. The system of claim 5, the actuation device further including a third laser configured to detect discharge of material through the discharge opening, the computing device being coupled to the third laser to measure the portion of the material.

8. The system of claim 1, wherein the imaging system identifies the capstan by identifying distance measurements in the first plurality of distance measurements that appear unconnected to surrounding structure.

9. The system of claim 1, wherein the imaging system is activated by movement of the railcar.

10. The system of claim 1, wherein the absolute value difference calculation includes comparing a color of an area in one image to a color of a corresponding area in another image and identifying overlapping areas.

11. The system of claim 10, wherein overlapping areas are identified as areas having substantially similar colors.

12. The system of claim 10, wherein movement of areas is indicated by non-overlapping areas.

13. The system of claim 12, wherein non-overlapping areas are identified as high contrast areas.

14. The system of claim 1, wherein the computing device controls movement of the drive surface to accommodate changes in position of the capstan engagement surface while the railcar is in an unloading position.

15. A method for unloading a railcar having a rotatable capstan for opening a discharge opening to discharge material from the railcar, the method including the steps of: generating a three-dimensional model of the railcar using a first camera and a first laser as the railcar moves past the first camera and the first laser; locating the capstan using the three-dimensional model; controlling movement of an actuation device toward the capstan using a second camera and a second laser mounted to the actuation device; and rotating the capstan using the actuation device to open the discharge opening.

16. The method of claim 15, wherein the generating step includes the step of performing an image analysis of adjacent sets of data from the first camera to determine movement of features of the undercarriage that pass through a field of view of the first camera.

17. The method of claim 15, wherein the first camera is configured to obtain images of an undercarriage of the railcar at predetermined intervals of time.

18. The method of claim 15, wherein the first laser is configured to determine distances to features of an undercarriage of the railcar at predetermined intervals of time.

19. The method of claim 15, wherein the locating step includes the step of comparing features of the three-dimensional model to known features of the capstan.

20. The method of claim 15, wherein the controlling step includes the step of performing an image analysis of adjacent sets of data from the second camera to determine apparent movement of features of the undercarriage as a field of view of the second camera passes the railcar when the railcar is in an unloading position.

21. A system for unloading a railcar having a door that is movable by a capstan between a closed position and an opened position wherein material in the railcar is discharge through a discharge opening, the system including:

a fixed imaging system including a first camera configured to obtain a first plurality of images of the railcar at predetermined intervals as the railcar moves past the first camera, and a first laser configured to obtain a first plurality of measurements of distances to features of the railcar at predetermined intervals as the railcar moves past the first laser, wherein the fixed imaging system generates a model of the railcar from the images and the measurements, identifies the capstan from the model, and tracks movement of the capstan away from the first camera by performing an absolute value difference calculation between adjacent images of the first plurality of images; and an actuation device including a frame mounted for movement substantially parallel to movement of the railcar along a rail, a power gate opener mounted to the frame, a second camera mounted to the frame and configured to obtain a second plurality of images of the railcar as the actuation device moves along the rail, a second laser mounted to the frame and configured to obtain a second plurality of measurements of distances to features of the railcar as the actuation device moves along the rail, and a computing device in communication with the fixed imaging system, the computing device being configured to control movement of the actuation device relative to the railcar by performing absolute value difference calculations between adjacent images of the second plurality of images and comparing a computed position of the actuation device to a position of the capstan as indicated by the model, and control movement of the power gate opener into engagement with the capstan to move the door into the opened position and discharge the material.

22. The system of claim 21, wherein the second laser is mounted at an acute angle relative to a drive shaft of the power gate opener.

23. The system of claim 21, wherein the first laser is a scanning laser configured to obtain a plurality of distance measurements along a vertical path at fixed intervals of time.

24. The system of claim 21, wherein the railcar includes a plurality of doors and a corresponding plurality of capstans and the computing device is configured to control movement of the power gate opener to move each of the plurality of capstans to open each of the plurality of doors.

25. The system of claim 21, wherein the absolute value calculation includes comparing a color of an area in a field of view corresponding to one data set to a color of a corresponding area in a field of view of another data set and identifying overlapping areas.

26. The system of claim 25, wherein overlapping areas are identified as areas having substantially similar colors.

27. The system of claim 25, wherein movement of areas is indicated by non-overlapping areas.

28. The system of claim 27, wherein non-overlapping areas are identified as high contrast areas.

29. The system of claim 21, wherein the computing device controls movement of the power gate opener to accommodate movement of the capstan during movement of the door into the opened position.

30. The system of claim 21, wherein the railcar remains in motion while the power gate opener engages the capstan to move the door into the opened position.

31. A system for unloading a railcar having a door that is movable between a closed position and an opened position wherein material in the railcar is discharged through a discharge opening, the door being movable by an actuation shaft having a capstan with an engagement surface, the system including:

an imaging system including a first camera and a first laser, the first camera obtaining first images of portions of the railcar and the first laser scanning portions of the railcar to obtain a first plurality of distance measurements, the imaging system being configured to identify the engagement surface of the capstan based on the first plurality of distance measurements, perform an image analysis of a plurality of the first images generated at predetermined intervals as the railcar moves past the imaging system to determine motion parameters of the railcar, the image analysis including an absolute value difference calculation between adjacent first images, and generate a model of the railcar using the motion parameters to determine the position of the capstan relative to the railcar when the capstan was identified, an actuation device including a frame mounted for movement along a rail, an encoder generating movement data of the actuation device along the rail, a power gate opener movably mounted to the frame and having a drive surface for engaging the capstan engagement surface, and a second laser scanning portions of the railcar to obtain a second plurality of distance measurements, and a computing device configured to receive information from the model and movement information from the encoder and use the information and the movement information to control movement of the actuation device along the rail toward the capstan, identify the capstan after the railcar stops moving by comparing the second plurality of distance measurements to known features of the capstan, control movement the drive surface of the power gate opener into engagement with the capstan engagement surface, and control the drive surface to rotate the capstan, thereby moving the door to the opened position to discharge material through the discharge opening of the gate assembly.

32. The system of claim 31, wherein the first laser is a scanning laser configured to obtain a plurality of distance measurements along a vertical path at fixed intervals of time.

33. The system of claim 31, wherein the actuation device further includes an articulated robot arm supporting the drive surface.

34. The system of claim 31, wherein the railcar includes a plurality of doors and a corresponding plurality of capstans and the computing device is configured to control movement of the power gate opener to move each of the plurality of capstans to open each of the plurality of doors.

35. The system of claim 31, wherein the imaging system identifies the capstan by identifying distance measurements in the first plurality of distance measurements that appear unconnected to surrounding structure.

36. The system of claim 35, wherein the imaging system identifies the orientation of the capstan by rotating a shape matrix representative of the shape of a drive recess of the capstan and performing a best fit analysis of the first plurality of distance measurements and the shape matrix.

37. The system of claim 31, wherein the absolute value difference calculation includes comparing a color of an area in one image to a color of a corresponding area in another image and identifying overlapping areas.

38. The system of claim 31, wherein the computing device is supported by the actuation device.

39. A car door opener for unloading a railcar having a door that is movable between a closed position and an opened position wherein material in the railcar is discharged through a discharge opening, the door being movable by an actuation shaft having a capstan with an engagement surface, the car door opener including:

a frame mounted for movement along a rail, an encoder generating movement data of the actuation device along the rail, a power gate opener movably mounted to the frame and having a drive surface for engaging the capstan engagement surface, a camera obtaining images of portions of the railcar;

a laser scanning portions of the railcar to obtain a plurality of distance measurements, and a computing device configured to perform an image analysis of a plurality of the images generated at predetermined intervals to generate motion information about the railcar, the image analysis including an absolute value difference calculation between adjacent first images, use the motion information to control movement of the car door opener along the rail, identify the capstan by comparing the plurality of distance measurements to known features of the capstan, control movement the drive surface of the power gate opener into engagement with the capstan engagement surface, and control the drive surface to rotate the capstan, thereby moving the door to the opened position to discharge material through the discharge opening of the gate assembly.

* * * * *